US007357084B2

(12) United States Patent
Wu et al.

(10) Patent No.: US 7,357,084 B2
(45) Date of Patent: Apr. 15, 2008

(54) GUIDEWAY STRUCTURE FOR HIGH-SPEED TRACK- BOUND TRANSPORTATION

(75) Inventors: Xiangming Wu, Shanghai (CN); Zhong Wu, Shanghai (CN)

(73) Assignee: Shanghai Maglev Transportation Development Co., Ltd., Shanghai (CN)

( * ) Notice: Subject to any disclaimer, the term of this patent is extended or adjusted under 35 U.S.C. 154(b) by 352 days.

(21) Appl. No.: 10/488,701

(22) PCT Filed: Jul. 1, 2002

(86) PCT No.: PCT/CN02/00466

§ 371 (c)(1),
(2), (4) Date: Mar. 5, 2004

(87) PCT Pub. No.: WO03/023144

PCT Pub. Date: Mar. 20, 2003

(65) Prior Publication Data

US 2004/0237830 A1 Dec. 2, 2004

(30) Foreign Application Priority Data

Sep. 7, 2001 (CN) ..... 01 1 26699

(51) Int. Cl.
*B61B 12/04* (2006.01)

(52) U.S. Cl. ..... 104/124

(58) Field of Classification Search ..... 104/118, 104/119, 120, 124; 238/115, 109; 52/726, 52/731

See application file for complete search history.

(56) References Cited

U.S. PATENT DOCUMENTS 4,993,095 A * 2/1991 Lautensleger et al. ..... 14/74.5
5,027,713 A * 7/1991 Kindmann et al. ..... 104/124
6,554,199 B1 * 4/2003 Flessner et al. ..... 238/115
6,564,516 B1 * 5/2003 Svensson ..... 52/174

FOREIGN PATENT DOCUMENTS

EP 1048784 A2 11/2000

* cited by examiner

*Primary Examiner*—S. Joseph Morano
*Assistant Examiner*—Robert J. McCarry, Jr.
(74) *Attorney, Agent, or Firm*—Rabin & Berdo, P.C.

(57) ABSTRACT

A guideway structure for high-speed track-bound transportation composed of two or more than two girder-segments. The structure of the guideway is characteristic of: At the intermediate positions on the girder top and the girder bottom of the connecting ends of the said girder-segments are all disposed the pre-embedded steel elements and some anchoring nails used for ensuring the pre-embedded steel elements to be reliably connected with the concrete of girder-segments, after the relevant connecting ends of the two adjacent girder-segments are placed closely, they may be connected together to form a two-span quasi-continuous girder by tightening a plurality of bolts through their respective through hole on the connecting elements and on the pre-embedded elements.

7 Claims, 6 Drawing Sheets

GUIDEWAY STRUCTURE FOR HIGH-SPEED TRACK- BOUND TRANSPORTATION

FIELD OF THE INVENTION

The invention relates to track-bound transportation, namely a modern high-speed track-bound transportation, and especially relates to a guideway structure suitable for high-speed magnetic levitation (maglev) transportation.

BACKGROUND OF THE INVENTION

The whole track is formed by connecting the guideway girders one by one; each of those is placed across two adjacent supporting columns. For the modern high speed track-bound transportation system such as the maglev train, etc. it requires that the guideway must be of extremely high accuracy, the deformation and the deflection of the guideway due to the influence of the factors of temperature difference, dynamic load and etc. must be controlled within a very small range, when the train is in high speed running. In the case of the traditional bridges, there is no difficulty to solve the problems of deflection and the hogging back of the girders caused by the temperature difference or dynamic load, but in the case of the guideway for the running of the modern high-speed track-bound vehicle, especially for the running of the maglev train, these small deformations caused by the temperature difference or dynamic load will influence the high-speed running of the train.

Through calculation it is known that in comparison of the structural functions of a continuous girder and two simply supported girders of the same section, the former has the superiority in the control of the deformation caused by the temperature difference and the dynamic load. But the guideway with continuous girder structure generally adopts such a construction mode, i.e. the girders have to be pre-fabricated in factory and then erected on site. Because the size and the weight of the continuous girder itself are too big, and in the meantime because the multi-span continuous girder belongs to a multi-point supported external hyper-static structure, in the process of transporting, lifting and installing the multi-span continuous girder must be kept in a multi-point supporting state from the beginning to the end, as well as the dislocations of any supporting point also must be controlled within a small range in order to ensure the safety of the multi-span continuous girder itself. If not, the damages of multi-span continuous girder will occur easily in the whole process of the guideway construction. Therefore in the process of the construction not only a parallel road of high class has to be built along the guideway which is specially used for transporting the multi-span continuous girder, simultaneously the special carrier for the multi-point supported girders and the crane specially for the multi-point synchronous lifting must be available. These will bring many difficulties in fabrication, processing, transportation, installation and positioning, as a result, the cost of fabrication and construction will greatly increase.

Under the action of temperature difference, all the support reaction forces of continuous girder at intermediate column, whether along vertical direction or along horizontal direction, generally are quite greater than those of simply-supported girder. From the view point of the viaduct foundation structure, it has a better function for resisting vertical reaction force, the increase of the vertical reaction force is insensitive to the construction cost of the lower foundation, but its function for resisting horizontal reaction force always is poorer. Each time, even a small increase of the horizontal reaction force caused by the upper structure will make a great increase of the material consumption for the lower foundation. It is especially so in the case of soft soil foundation.

The German Patent DE19936756 disclosed a method to connect several simply-supported type girders to be a continuous girder as shown in FIG. 1. The method of Patent DE19936756 yet is to connect these simply-supported type girders to be an entirely continuous girder whether observing it along vertical direction or observing it along horizontal direction, namely it is connected to be a truly continuous girder. Thus, such a structural mode cannot overcome the disadvantage that in this case the horizontal support reaction force of the continuous girder at the intermediate column is too big, so it is unable to achieve the objective of decreasing the construction cost of the lower foundation.

Additionally, in Patent DE19936756 a mode of embedded guide-screws and toothed-structure is used for connecting and positioning two simply-supported girder-segments. Because the guide-screw and the toothed structure all are embedded and positioned before pouring concrete or formed during pouring concrete, even though two adjacent segments of girder are poured at the same time, yet it can only be ensured that the positions relative to the concrete structure elements between two adjacent girder-segments are aligned. But for the structure of maglev guideway line or other high-speed track-bound transportation, the accurate positioning of space position means the continuous alignment of the phase positions among all the functional surfaces of the track. Moreover, the dimensions and positions of these functional surfaces are determined by the successive machining and the accurate assembly carried out after the pre-fabrication of the concrete main body of guideway girder has been completed. In this case, the dimensions of original guideway girder structural element had been corrected by reducing or complimentarily adding material, thus the dimensions and positions of finally-finished functional surfaces of the guideway girder are far different from those of the original concrete girder-segment structural element. Hence the method of using embedded guide-screws and toothed structures of Patent DE19936756, in fact, cannot achieve the objective for accurately positioning two adjacent girder-segments.

CONTENTS OF THE INVENTION

The technical problem need to be solved by the invention is to overcome the aforesaid existing technical deficiencies and to provide a guideway structure suitable for the high-speed track-bound transportation. To be specific, connecting a plurality of simply-supported girder-segments together to be a multi-span quasi-continuous girder aims to utilize fully the advantage of the continuous girder that the deformation caused by temperature difference and dynamic load may be controlled to be smaller, and that the difficulties in pre-fabricating, processing, transporting and installing a bigger and heavier continuous girder may be conquered.

The conception of the invention is that every girder-segment laid across two adjacent supporting columns of the guideway is fabricated, processed, transported, installed and accurately positioned as a simply-supported girder, then these girder-segments across two spans (or a plurality of spans) are connected together to be a quasi-continuous girder, which has a structure mode approximate to a continuous girder with a bending-rigidity as large as possible in vertical plane (i.e. a direction around Y-axis) and has a structure mode approximate to a quasi-continuous girder by a structure mode to hinge-joint many of two- or multi-span simply-supported girder-segments together one by one and with a bending-rigidity as small as possible along horizontal direction (i.e. a direction around Z-axis).

The Technical Solution is as Follows:

A track structure for high-speed track-bound transportation inclusive of two or more than two girder-segments is characteristic of the following:

In the laterally intermediate portions of girder top and girder bottom at the connected ends of girder-segment are disposed the steel pre-embedded elements and many anchoring nails used for ensuring the pre-embedded elements to be reliably connected with the concrete of the girder-segment. When the connecting end of one girder-segment is placed close up to that of the other, then these two girder-segments may be connected to be a quasi-continuous girder by tightening the bolts through their respective screw-holes on the connecting elements and the pre-embedded elements;

The aforesaid girder-segment may be a solid one or a hollow one (inclusive of empty chamber 3);

The aforesaid pre-embedded element is a concave-shape steel plate;

On the aforesaid concave-shape embedded element are disposed the rolled-wire slant anchors for applying prestress;

Furthermore, on the aforesaid concave-shape embedded element for the rolled-wire slant anchors also are disposed the horizontal anchor bar;

Additionally, by means of tightly pressing the concave shape embedded elements in the girder top at connecting end of girder-segment with post-tensioned prestress reinforcing bar, these two adjacent girder-segments will be connected more tightly and firmly;

The aforesaid girder-segment is a reinforced concrete girder;

The aforesaid girder-segment is a pestressed concrete girder;

The connection of the aforesaid connecting elements and embedded elements also may employ the weld connection mode;

If the aforesaid girder-segment is of steel structure, the connection mechanism may be further simplified, the connecting elements will be simply connected respectively with the top plates or the bottom plates of these two or more than two steel structure girder-segments with bolts or by welding;

The upper and the lower connecting elements are respectively placed at the inner sides of the upper top plate and the lower bottom plate in the steel girder chamber;

The aforesaid connecting elements may have various types, e.g. plate type (for connecting steel plates), block type, column type or tube type.

BRIEF DESCRIPTION OF APPENDED DRAWINGS

1, 2—girder segments;
3—empty chamber;
4—rolled-wire slant anchor;
5—post-tensioned pre-stressed reinforcing bar;
6—pre-embedded steel connecting element (pre-embedded element);
7—vertical anchoring nail;
8—connecting steel plate;
9—bolt;
10—horizontal anchor bar;
11, 12—steel structure girder-segments;
13—weld-joint place;
14—top plate;
15—bottom plate;
16—weld-joint place.

DESCRIPTION OF THE EMBODIMENTS

Figure 1:
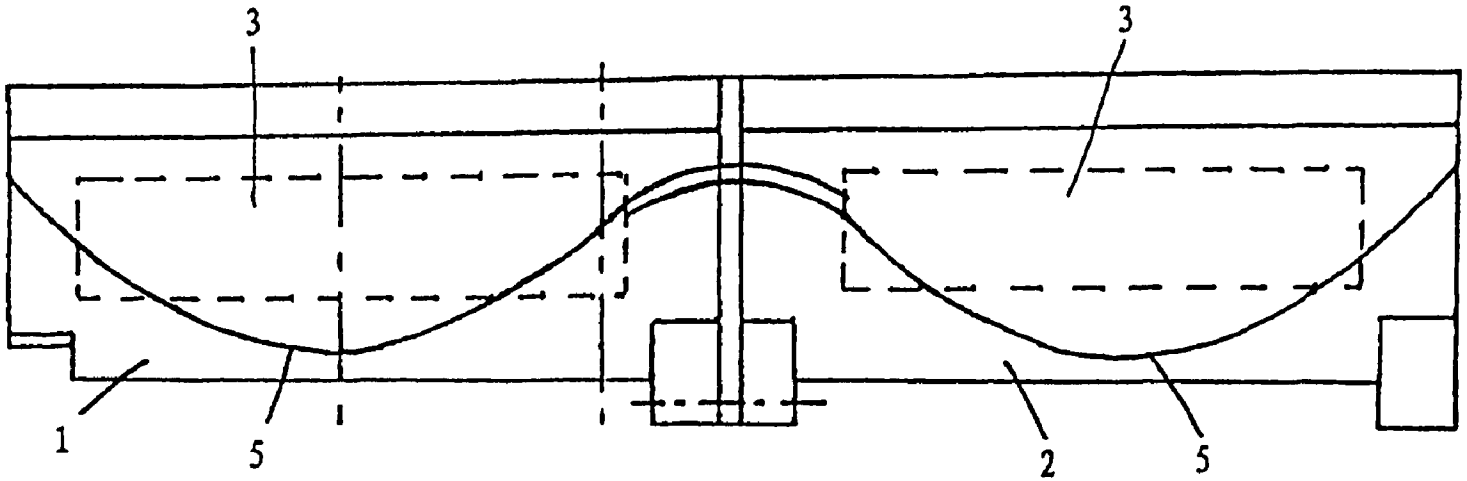
Fig. 1 PRIOR ART
FIG. 1 is a schematic diagram of 2-span girder consisting of 2 segments of the existing technology.
Figure 2:
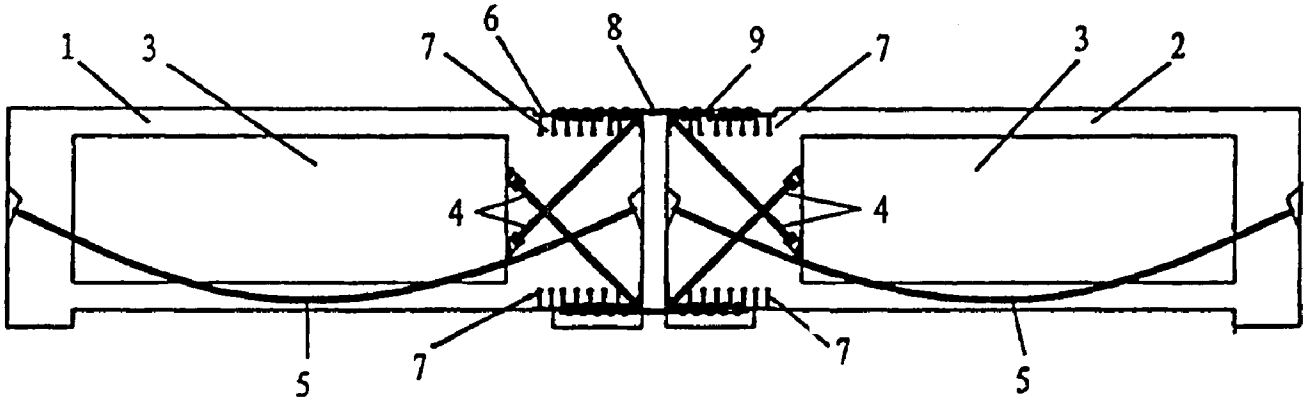
FIG. 2 is a structural schematic diagram of a guideway girder connected by two concrete girder-segments in embodiment 1 of the invention.
Figure 3:
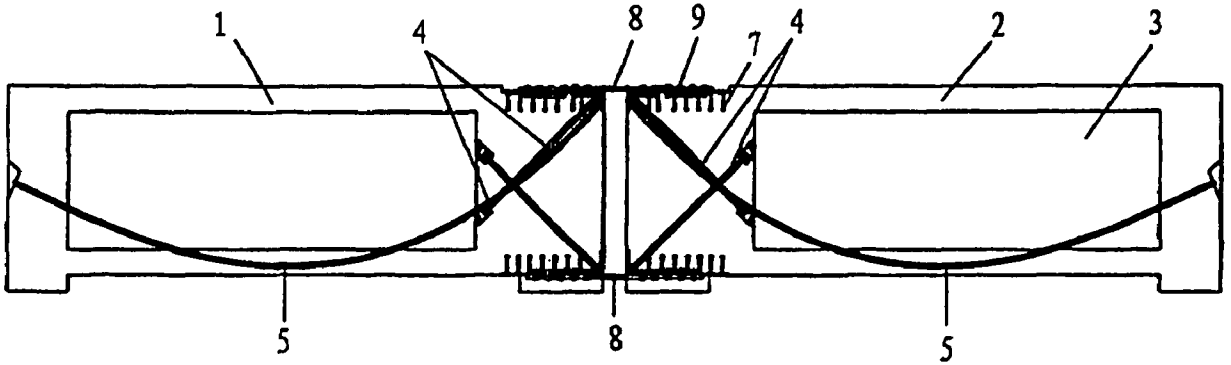
FIG. 3 is a schematic diagram of embedded element tightly pressed by post-tensioned reinforcing bar.
Figure 4:
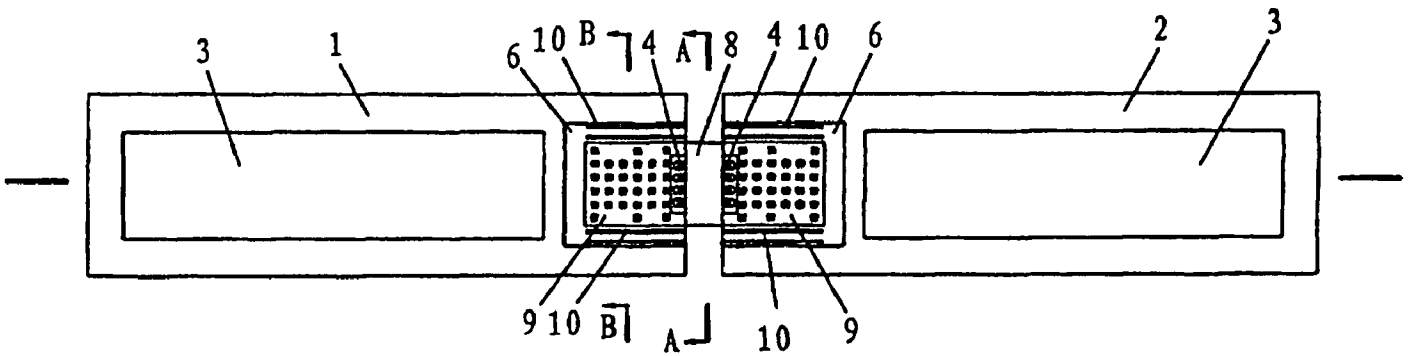
FIG. 4 is a plan view of FIG. 2.
Figure 5:
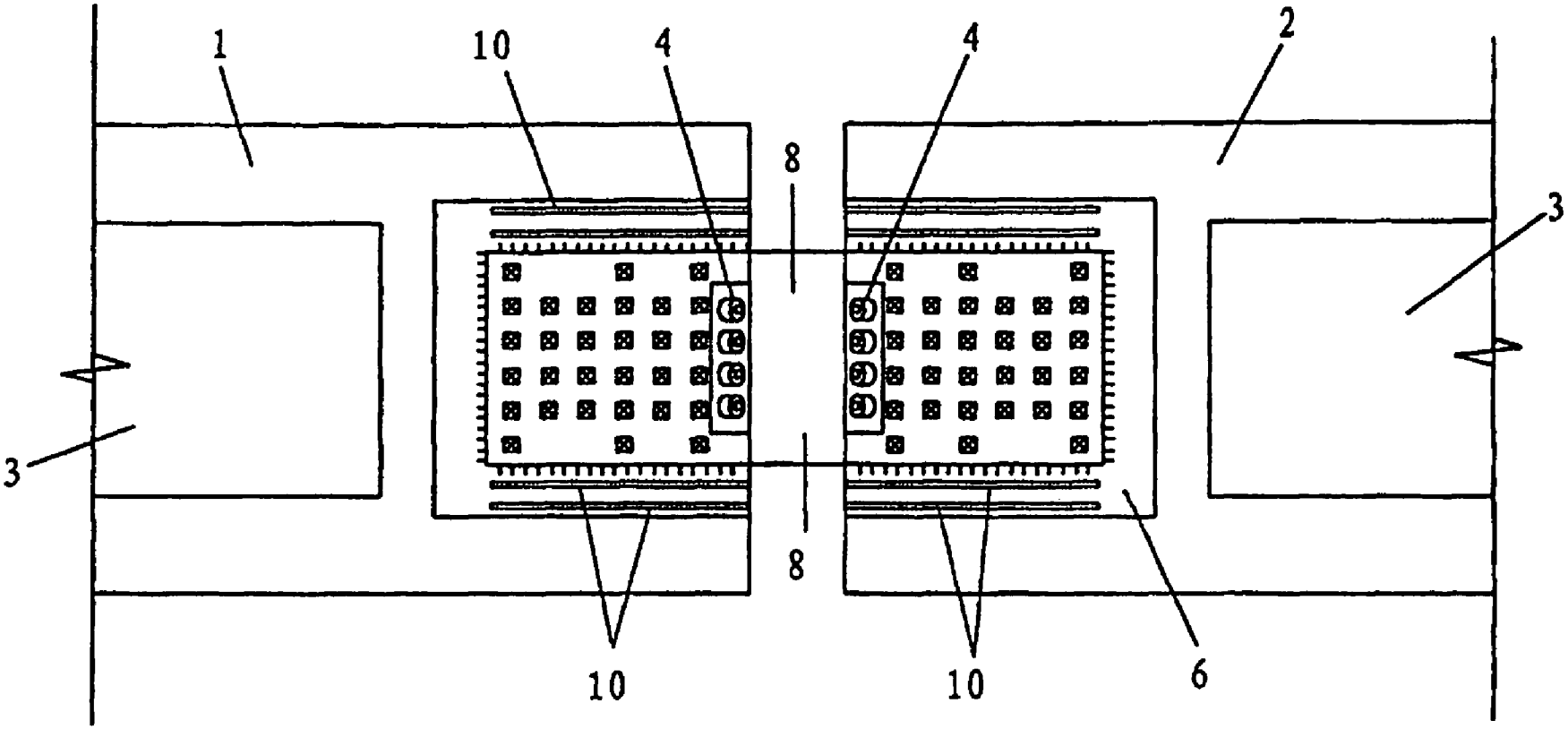
FIG. 5 is a locally enlarged schematic diagram of the connecting portion in FIG. 4.
Figure 6:
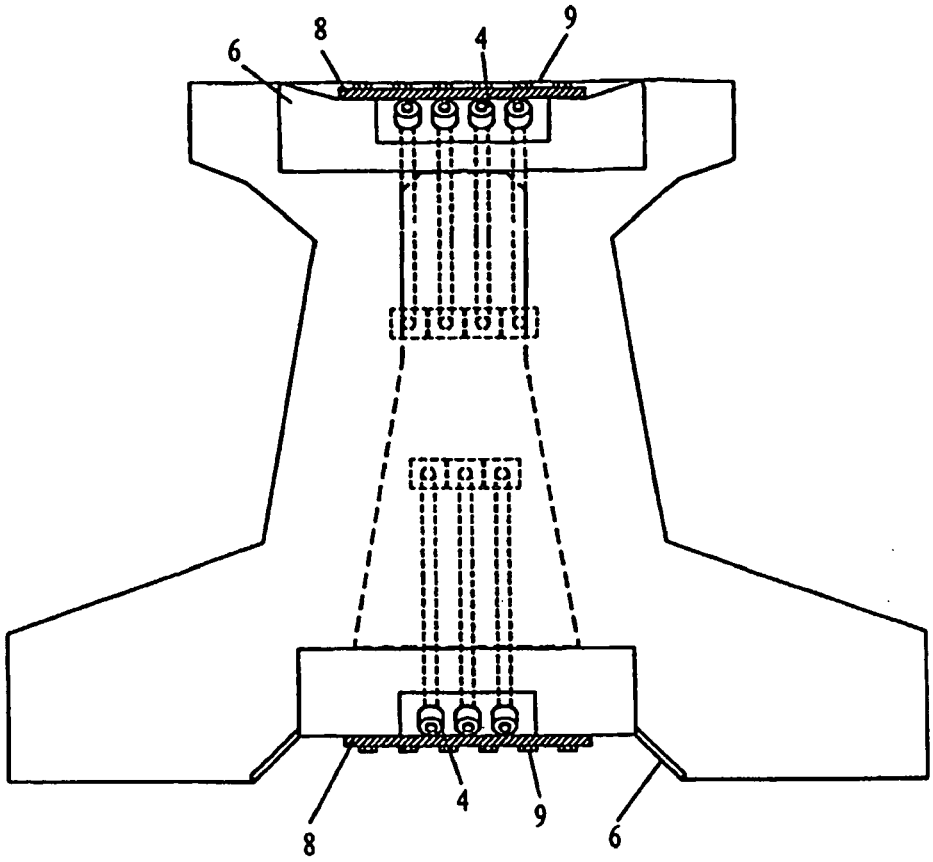
FIG. 6 is a schematic diagram of section along line A-A in FIG. 4.
Figure 7:
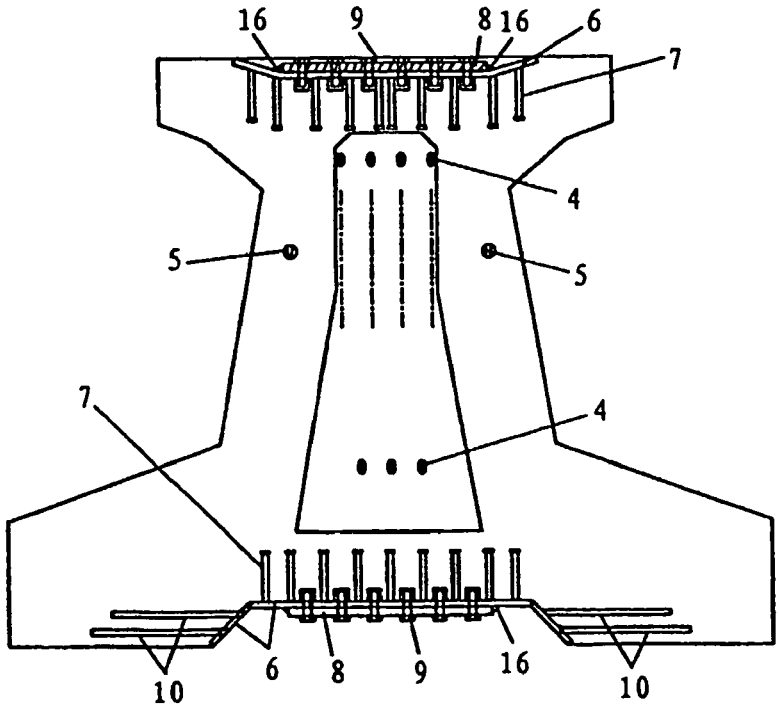
FIG. 7 is a schematic diagram of section along line B-B in FIG. 4.

FIG. 2 is a schematic structural diagram of the guideway girder formed by two connected concrete girder-segments in embodiment 1 of the invention. It is a horizontally hinge-jointed and approximate to a continuous two-span guideway structure in vertical plane. Referring to FIGS. 3 to 7, embodiment 1 is a girder composed of concrete girder-segments 1 and 2. The girder-segment is a hollow girder with an empty chamber 3. In girder-segments are disposed the reinforcing bars. The connection structure between girder-segments 1 and 2 is formed by concave-shape pre-embedded steel connecting element 6 (briefly called pre-embedded element), vertical anchoring nails 7 are firmly connected with the pre-embedded element 6, connecting steel plate 8 and bolts 9. In embodiment 1, besides the vertical anchoring nail and horizontal anchor bar are designed, the rolled-wire slant anchor, which may apply slant pre-compressive force, is also specially designed in order to resist the horizontal force and the potential upward bending force acted between two girder-segments. As shown in FIGS. 4, 5 and 7, the above structure can ensure a reliable connection and a reliable force transferring between two girder-segments.

For further reliably ensuring the connection and force-transferring between pre-embedded element and girder-segment 1 or 2, the anchoring points of post-tensioned reinforcing bars 5 at the connecting ends of girder-segments 1 and 2 may be moved upward to press against the pre-embedded elements 6. As shown in FIG. 3 it is equivalent to applying a certain pre-compressive force on the pre-embedded element 6.

The aforesaid pre-embedded elements 6 are respectively disposed in girder top and girder bottom at the connecting ends of girder-segments 1 and 2. The aforesaid connecting steel plates 8, in a total of two pieces, are respectively disposed at intermediate position of girder top and girder bottom at the connecting end of girder, thus girder-segments 1 and 2 may be connected together with bolts 9 passing through the corresponding through-holes on pre-embedded elements 6 and connecting steel plates 8. By so doing, the vertical spacing between two connecting steel plates 8 may be as large as possible and they are also respectively placed at the intermediate points along the horizontal direction. Such a structure may ensure that the horizontal bending-rigidity is far less than that in the vertical plane, the former less than 5% of the latter, and more ideally carrying out the connection between two (or more than two) girder-segments in the vertical plane, approximate to continuous one as well as the connection between each two girder-segments in horizontal plane still approximate to a hinge-joint of the original design conception. Namely, in vertical plane the girder-segments are connected together to be a two-span or multi-span continuous girder and in horizontal plane each of them is still as a simply-supported girder. The results of calculation and practical structure measurement show that: in comparison of the structure of the invention and that of an entirely continuous multi-span girder, their characteristics are quite close in the control of deformation caused by temperature variation and dynamic load.

In connection mode, the connection between connecting steel plate 8 and pre-embedded steel element 6 may utilize either weld connection mode (weld line 12) or bolt 9 connection mode, the latter may adopt the finish bolt connection mode or the high strength bolt connection mode. In case that the high strength bolt connection mode is adopted, both contact surfaces of the connecting steel plate 8 and concave-shape pre-embedded steel plate 6 have to be processed by sand blasting. The sand blasting technology must meet the process requirement of the friction surface for high strength bolt connection of steel structure.

In a certain degree twisting warping and bending deflection maybe exist between two adjacent girder-segments, especially between two girder-segments with composite deformation, it will cause two pre-embedded steel plates 6 unable to be laid completely in a same plane with a result in connection that the connecting steel plates 8 cannot closely contact with them, then the force-transferring will be affected by it. In this case the shape of relevant connecting steel plate 8 may be suitably rectified through flame heating in the center and water cooling during construction process to make it closely contact with these two pre-embedded steel plates 6 of the girder-segments, namely, by means of the distorting deformation of steel plate 8 to adapt to the space positioning of two adjacent girder-segments. This guarantees that the displacement of the accurately positioned girder-segments will not occur because of the connection of girder-segments.

Due to sunshine and ambient temperature variation, the temperature difference between the girder top and the girder bottom surfaces exist and will cause a hogback deformation of the girder-segments. Under normal conditions, the temperature of girder top surface is higher than that of the girder bottom surface, thus in most cases, the hogback deformation is convex upward, its direction is just reverse to that of deflect deformation caused by the train dynamic load. If their magnitudes are equal, they will be balanced each other. Of course, it is the most ideal status, so that an optimal comfort can be achieved when the train passes through the guideway line with high-speed. But in fact, the deflection is controlled by the bending rigidity of girder itself and the temperature difference varies with time, seasons and weather, therefore their magnitudes are always different in a certain degree. Because the connection structure of the invention can tightly lock the connecting steel plates 8 under the condition of a selected temperature variation range or a selected girder deflection range, it can play the role of fine adjustment to the above differences, controlling the deformation difference caused by various factors to a smaller range and achieve the purpose of optimal train comfort.

Although other measures have been taken in the girder design, for a reinforced concrete girder, it is difficult to completely avoid the increase of deflection caused by contraction and creep of concrete as time goes on. After the train has been operated for many years, if the deflection caused by contraction and creep of concrete is large enough to affect the requirements of train running, in this case, the fabrication method and the structure of the invention can be adopted. The connections between two adjacent girder-segments may be loosened and then the relevant connecting steel plates 8 will not be tightly locked again until the hogging back of girder caused by temperature difference is relatively big or the hogging back of girder is increased to a certain magnitude through application of external force. The objective for balancing the deflection caused by concrete and creep of concrete may be achieved by this method, and the guideway structure for high-speed train in its whole service life may be ensured to meet the requirement on dimensional tolerance for the operation of high-speed traffic system.

Figure 8:
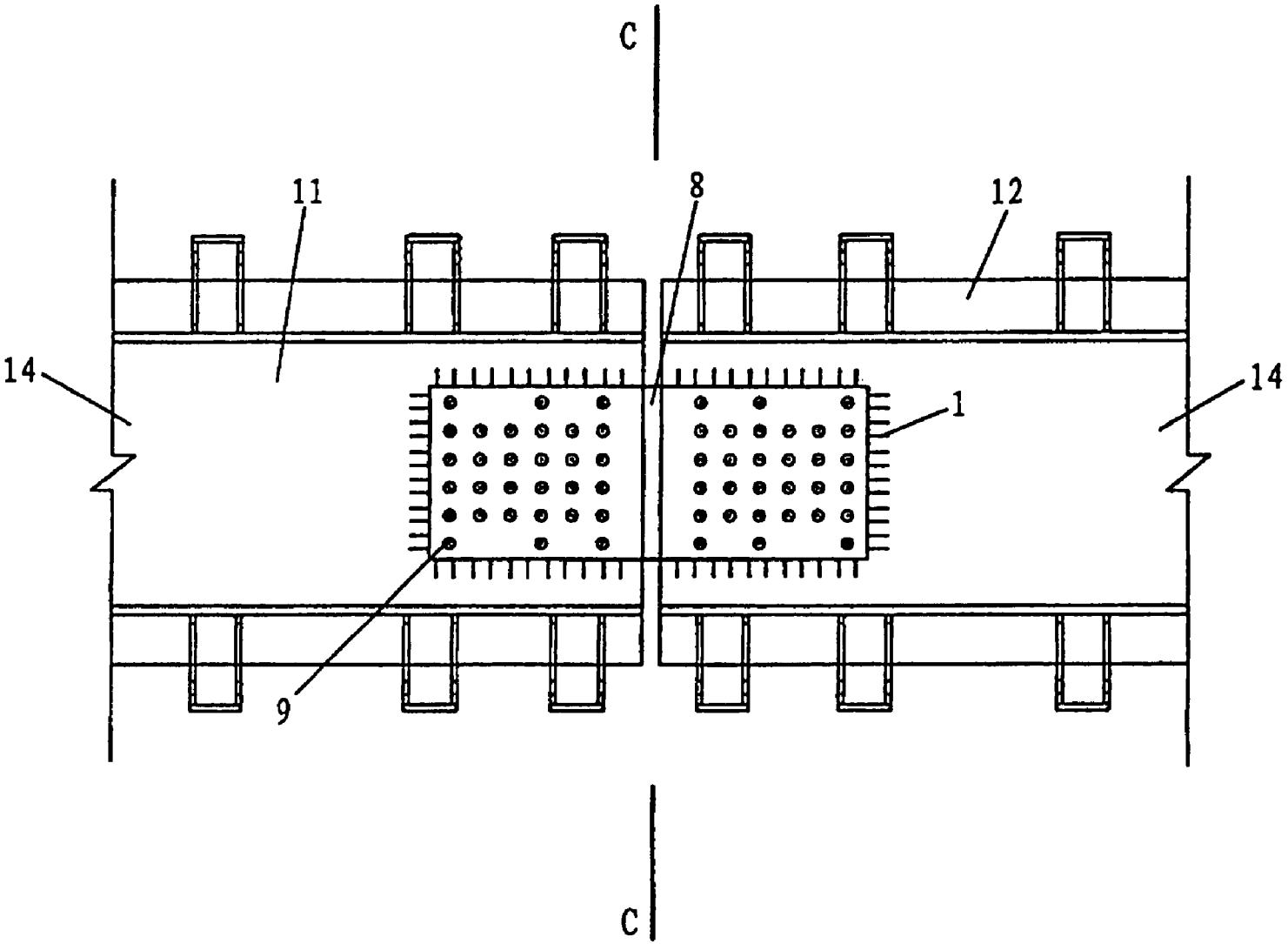
FIG. 8 is a structural schematic diagram of guideway girder formed by two connected steel girder-segments in embodiment 2 of the invention.
Figure 9:
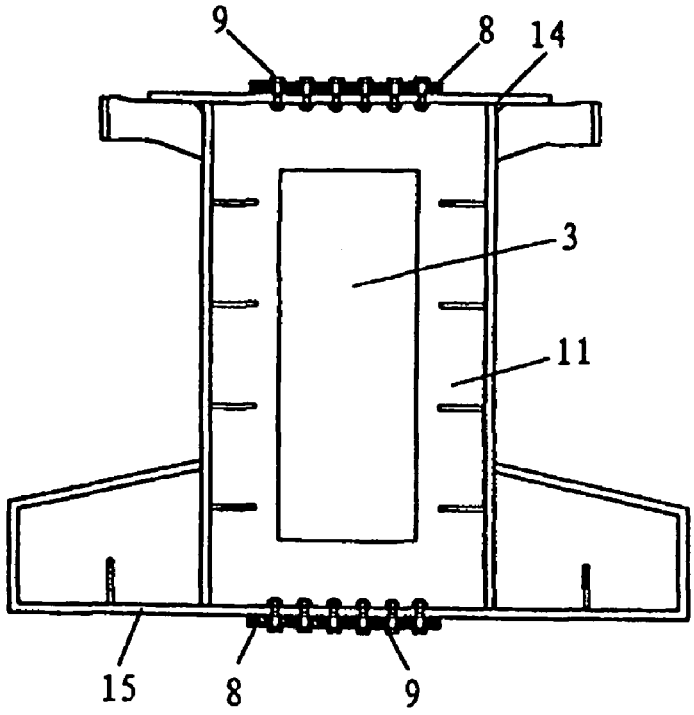
FIG. 9 is a schematic diagram of section along line C-C in FIG. 8.

FIG. 8 is a schematic structural diagram of the guideway girder in embodiment 2 of the invention, which is formed by two connected steel girder-segments 11 and 12. Referring to FIG. 9, the guideway structure may be further simplified, in this case two adjacent steel girder segments are able to be connected only by directly connecting the relevant connecting steel plates 8 with their respective top plate 14 and bottom plate 15 of the steel girder-segments 11 and 12 with bolt or using the weld connection mode, thus the pre-embedded elements 6 for the connection between the concrete girder-segments 1 and 2, as well as the corresponding anchor elements such as vertical anchoring nails 7, horizontal anchor bars 10 and rolled-wire slant anchor 4 all may be omitted.

Figure 10:
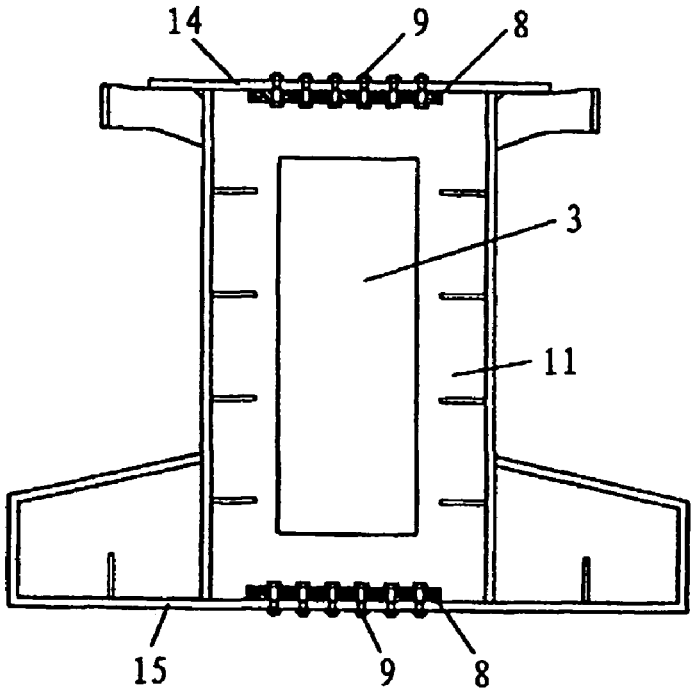
FIG. 10 is schematic position diagram of steel connecting plate disposed in empty chamber of a steel girder.

For the convenience of installation and no influence on the operational space of train, the upper and the lower connecting steel plates 8 also may be respectively disposed at the inner side of top plate 14 and bottom plate 15 of the empty chamber 3 of steel girder-segment as shown in FIG. 10.

Synthesizing above description, the improved technical effects of the invention are as follows:

1. A quite difficult technical problem in respect of the fabrication, transportation and installation of the big and heavy multi-span guideway girder may be conquered and the construction cost of modem high-speed track-bound transportation, especially that of maglev guideway may be quite greatly saved, because each of girder-segments of guideway may be pre-fabricated, processed, transported, installed and accurately positioned as simply-supported girders and then two or more than two girder-segments may be connected together to be a two-span or multi-span quasi-continuous guideway girder with the connection mechanism.

2. The connection mechanism of girder-segments of the invention is one composed of pre-embedded elements respectively disposed on girder top and girder bottom of girder-segment's connecting ends, or composed of two connecting steel plates respectively disposed on girder top and girder bottom of girder-segment's connecting ends, as a result the vertical spacing between the two connecting plates can be as large as possible and in lateral plane they are respectively placed at intermediate positions of girder-segment's connecting ends, able to ensure the bending rigidity of the connection in lateral plane is far smaller than that in vertical plane. In other words, in vertical plane the girder-segments are connected together to be a two-span or multi-span quasi-continuous girder but in horizontal plane each of girder-segments is still kept as a simply-supported girder connected with other adjacent ones;

3. The connection mechanism of the invention relatively is simple and able to provide a convenient condition for repair and maintenance in future.

The above only exemplifies the optimal embodiments of the invention and the connection of a two-span girder-segments is described as an example. That does not mean that the structure of the invention may be popularized to the connection of multi-span girder-segments. It cannot be understood that the present invention is limited to these exemplified embodiments and relevant descriptions. Any simple modifications in the application of the conception and the structure of the present invention belong to the scope of protection of the present invention.

We claim:

1. A guideway structure for high-speed track-bound transportation comprising two or more girder-segments, wherein the guideway structure further comprises:

pre-embedded elements disposed on a girder top surface and a girder bottom surface of connecting ends of said girder-segments, anchoring nails associated with said pre-embedded elements to additionally fasten the pre-embedded elements to concrete parts of said girder-segments, and connecting elements configured to be placed in a horizontal direction across said connecting ends of adjacent said girder-segments, wherein the connecting ends of adjacent said girder-segments are configured to be connected together to form a quasi-continuous girder by a plurality of fasteners configured to pass through the connecting elements and the pre-embedded elements; and wherein said pre-embedded elements are concave-shaped plates.

2. The guideway structure for high-speed track-bound transportation of claim 1 wherein on said concave-shaped plates are also disposed rolled-wire slant anchors for applying prestress.

3. The guideway structure for high-speed track-bound transportation of claim 2 wherein on said concave-shaped plates with rolled-wire slant anchors thereon are also disposed horizontal anchor bars.

4. The guideway structure for high-speed track-bound transportation of claim 3 wherein said concave-shaped plates respectively placed on the girder top surfaces of said connecting ends of said girder-segments are pressed tightly by a post-tensioned prestress reinforcing bar in order that said pre- embedded elements can be further firmly connected respectively with said girder- segments.

5. The guideway structure for high-speed track-bound transportation of claim 1 wherein said girder-segment is a reinforced concrete girder.

6. The guideway structure for high-speed track-bound transportation of claim 1 wherein said girder-segment is a prestressed reinforced concrete girder.

7. The guideway structure for high-speed track-bound transportation of claim 1 wherein a weld connection mode may also be used for the connection of the said connecting elements and the said pre-embedded elements.

* * * * *